US007070388B2

(12) United States Patent
Meng et al.

(10) Patent No.: US 7,070,388 B2
(45) Date of Patent: Jul. 4, 2006

(54) INDUCER WITH SHROUDED ROTOR FOR HIGH SPEED APPLICATIONS

(75) Inventors: Sen Y. Meng, Reseda, CA (US); David H. Loh, Agoura, CA (US)

(73) Assignee: United Technologies Corporation, Hartford, CT (US)

( * ) Notice: Subject to any disclaimer, the term of this patent is extended or adjusted under 35 U.S.C. 154(b) by 78 days.

(21) Appl. No.: 10/787,914

(22) Filed: Feb. 26, 2004

(65) Prior Publication Data

US 2005/0191172 A1 Sep. 1, 2005

(51) Int. Cl.
*F01D 5/22* (2006.01)

(52) U.S. Cl. ..... 415/173.6; 415/174.2; 416/189; 416/228; 416/195; 416/196 R

(58) Field of Classification Search ..... 415/228, 415/173.6, 174.2, 58.7, 110, 140; 416/189, 416/195, 196 R, 228, 181, 174, 179
See application file for complete search history.

(56) References Cited

U.S. PATENT DOCUMENTS

| | | | | |
|---|---|---|---|---|
| 2,278,041 | A * | 3/1942 | Allen | 416/196 R |
| 2,724,544 | A * | 11/1955 | Hardigg | 415/209.4 |
| 4,721,313 | A | 1/1988 | Pennink | |
| 6,854,958 | B1 * | 2/2005 | Desy | 415/173.6 |

* cited by examiner

*Primary Examiner*—Edward K. Look
*Assistant Examiner*—Richard A. Edgar
(74) *Attorney, Agent, or Firm*—Kinney & Lange, P.A.

(57) ABSTRACT

An inducer rotor rotatably mountable in an inducer for pressurizing fluid traveling through the inducer. The inducer rotor includes a hub. The hub has a central axis and a plurality of blades extending radially outward from the hub. Each blade extends from a root portion that is next to the hub, to a tip portion that is opposite the root. The rotor further includes a shroud extending circumferentially between each pair of adjacent blades within the plurality of blades. The shroud has an inner surface facing the central axis and an outer surface that is opposite the inner surface. Between the inner and outer surface of the shroud is defined a thickness. The shroud thickness varies circumferentially around the shroud.

21 Claims, 4 Drawing Sheets

INDUCER WITH SHROUDED ROTOR FOR HIGH SPEED APPLICATIONS

BACKGROUND OF THE INVENTION

The present invention relates to inducers, and more particularly to inducers having shrouded rotors.

Inducers are commonly used to pressurize fluid. Generally, inducers comprise a rotor rotatably mounted in a static housing. The rotor includes a hub and a plurality of blades extending outward from the hub. Conventional inducers operate at relatively low operating speeds (i.e., the rotor rotates at relatively low speeds in the housing). At intermediate speeds, blade erosion commonly occurs due to cavitation of fluid against the blades and flow separation near the blade tips.

One solution to the erosion problem is to operate inducers at lower operating speeds, i.e., below an empirical blade erosion-free speed. For example, operating speeds of about 152 m/s (i.e., about 500 ft/s) in a liquid oxygen (LOX) environment have been common. The lower operating speeds result in lower performance levels, and thus more impeller stages are required in a pressurizing system. For example, instead of requiring one inducer, or a few inducers in series to accomplish a desired total pressure increase, many more inducers are required. Cost and complexity increase with the number of inducers.

Another solution for the blade erosion and failure problem, often used in combination with the lowering speed solution, is to provide a circumferential shroud extending between each adjacent pair of blades. These conventional shrouds have a constant thickness around the circumference of the shroud. However, adding such a shroud greatly increases pump weight and cost.

Though the typical inducer shroud alleviates the erosion problem, structural problems can occur at higher speeds. For example, shrouds may deform radially to such an extent that they rub against the inducer housing. Alternatively, more clearance may be left between the shroud and the inducer housing, but this reduces pump efficiency. These problems necessitate operation of inducers at lower speeds, which causes poor performance.

SUMMARY OF THE INVENTION

The present invention relates to an inducer rotor rotatably mountable in an inducer for pressurizing fluid traveling through the inducer. The inducer rotor includes a hub having a central axis and a plurality of blades connected to the hub. Each blade extends radially outward from a root adjacent the hub to a tip opposite the root. The rotor further includes a shroud extending circumferentially between each pair of adjacent blades within the plurality of blades. The shroud has an inner surface facing the central axis, an outer surface opposite the inner surface, and a thickness extending between the inner and outer surfaces. The thickness varies circumferentially around the shroud.

In another aspect, the present invention includes an inducer for pressurizing a fluid. The inducer includes a housing having an interior surface facing a central axis, an inlet through which fluid is received into the housing at an inlet pressure, and an outlet downstream from the inlet through which fluid is discharged from the housing at an outlet pressure higher than the inlet pressure. The inducer further includes a rotor rotatably mounted in the housing. The rotor includes a hub centered on the central axis and a plurality of blades connected to the hub. Each blade extends radially outward from a root adjacent the hub to a tip opposite the root and axially rearward from a leading edge to a trailing edge opposite the leading edge. The rotor further includes a shroud extending circumferentially between each pair of adjacent blades within the plurality of blades. The shroud has an inner surface facing the central axis, an outer surface opposite the inner surface, and a thickness extending between the inner and outer surfaces. Further, the inducer includes a leading seal extending from at least one of the interior surface of the housing and the outer surface of the shroud, thereby forming a leading seal gap, and a trailing seal extending from at least one of the interior surface of the housing and the outer surface of the shroud, thereby forming a trailing seal gap. The leading seal is closer to the leading edge of the blades than the trailing seal. The interior surface of the housing, the outer surface of the shroud, the leading seal, and the trailing seal define an annular cavity. The cavity is pressurized for maintaining the leading seal gap and the trailing seal gap at respective substantially uniform heights during inducer operation.

Other aspects of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE EMBODIMENTS

Figure 1:
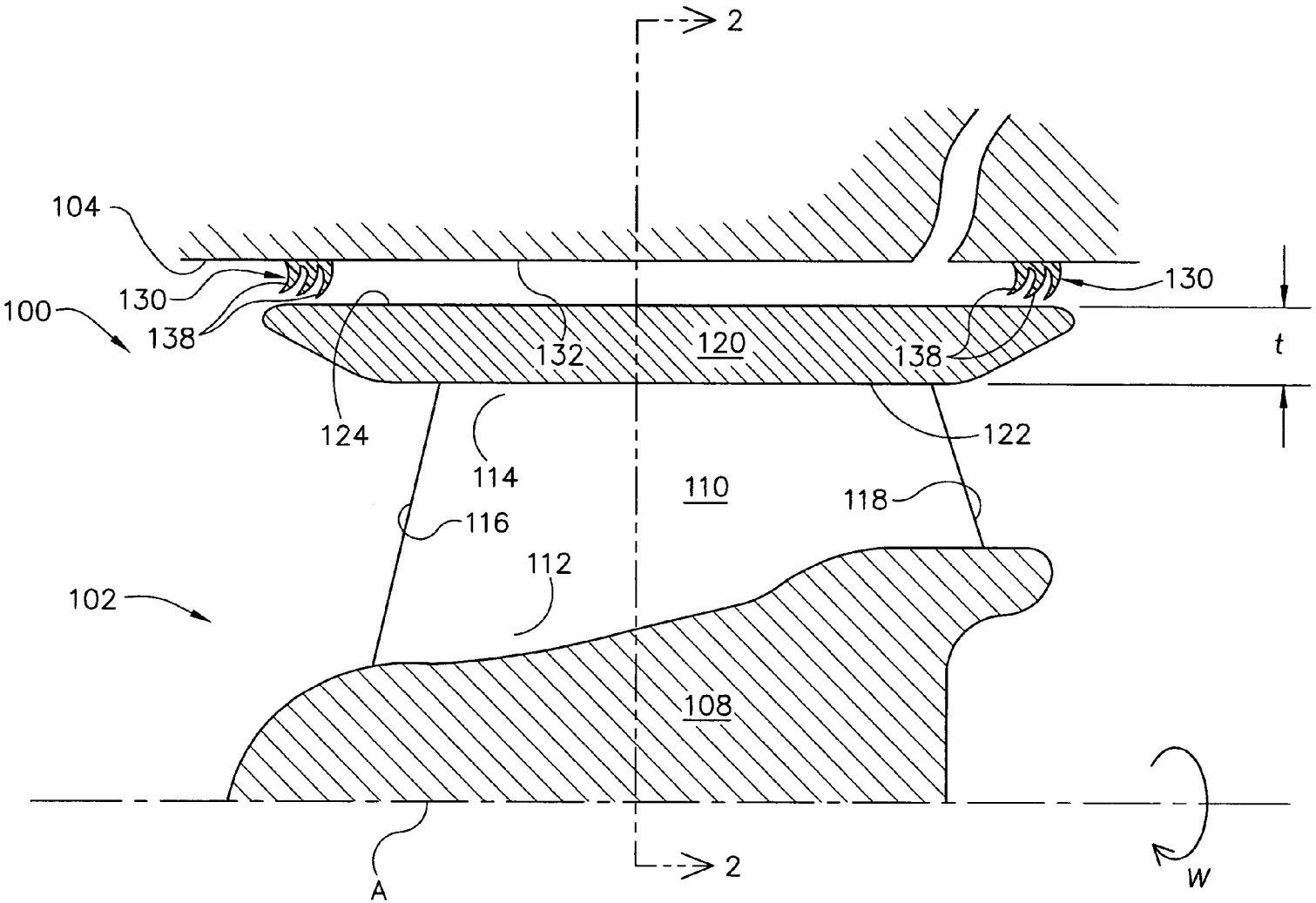
FIG. 1 is a partial vertical cross section of an inducer according to the present invention.

Referring now to the drawings, and more particularly FIG. 1, an inducer of one embodiment of the present invention is designated in its entirety by the reference number 100. The inducer 100 generally comprises an inducer rotor, generally designated by 102, rotatably mounted in a static housing 104. As the inducer rotor 102 rotates in the housing 104, it pressurizes fluid traveling through the inducer 100. The inducer may be made of, for example, Inconel 718. Inconel is a federally registered trademark of Huntington Alloys Corporation of Huntington, W.Va. Contemplated fluids for use with this invention include water, liquid sodium, and liquid oxygen. Other fluids may also be used, including both compressible and incompressible fluids. The inducer rotor 102 includes a hub 108. The hub 108 has a central axis "A" and a plurality of blades 110 extending radially outward from the hub 108. Although the inducer rotor 102 has four equally circumferentially spaced blades 110, resulting in spacing angles of 90°, in one embodiment, the rotor may have various number of equally spaced blades 110 without departing from the scope of the present invention. The number, and thus spacing, of blades is determined primarily by consideration of the generally opposing requirements of stress analysis and fluid mechanics. Stress requirements prefer a larger number of blades 110 to reduce loading on each blade. On the other hand, fluid mechanics requirements prefer fewer blades, and thus less structure impeding the fluid flow and dynamics.

Each blade 110 extends from a root 112 next to the hub 108 to a tip 114 opposite the root. Each blade 110 also extends axially rearward from a leading edge 116 to a trailing edge 118 opposite the leading edge. The rotor 100 further includes a shroud 120 extending circumferentially between each pair of adjacent blades 110 within the plurality of blades 110. In one embodiment, the shroud 120 extends circumferentially between blades 110 adjacent the tips 114 of the blades to reduce flow separation at the blade tips. The shroud 120 has an inner surface 122 facing the central axis "A", an outer surface 124 opposite the inner surface 122, and a thickness "t" extending between the inner surface 122 and outer surface 124 of the shroud.

A plurality of seals, generally designated by 130, may extend from either or both of an interior surface 132 of the housing 104 and the outer surface 124 of the shroud 120. In one embodiment, each seal 130 includes a plurality of axially spaced teeth 138 extending circumferentially around the inducer 100. Seals 130 may extend inward from the interior surface 132 of the housing 104 toward the outer surface 124 of the shroud 120. Alternately or in addition, seals may extend outward from the shroud 120 toward the interior surface 132 of the housing 104.

In operation, fluid enters the inducer 100 at an inlet adjacent the leading edges 116 of the blades 110 and is discharged through an outlet downstream from the inlet and adjacent the trailing edges 118 of the blades. Fluid entering the inducer 100 through the inlet has an inlet pressure, and fluid exiting the inducer through the outlet has an outlet pressure higher than the inlet pressure. The rotor 102 also has a predetermined operating pressure between the inlet and outlet pressures. In one embodiment, the rotor operating pressure is between about 34.5 kPa and about 10,340 kPa (i.e., about 5 psi and 1,500 psi). The rotor 102 also has a predetermined rotational operating speed "ω". When the rotor 102 is operating at the predetermined rotational operating speed "ω", the blade tips 114 have a circumferential tip speed "S". In one embodiment, the rotational operating speed "ω" is between about 6,000 rpm and about 30,000 rpm. Further, in one embodiment the blade tip speed "S" is between about 46 m/s and about 290 m/s (i.e., about 150 ft/sec and about 950 ft/sec). For example, in one embodiment when the rotational operating speed "ω" is about 23,900 rpm, the blade tip speed "S" is about 285 m/s (i.e., about 936 ft/sec). A blade tip speed "S" of 285 m/s in a liquid oxygen environment is about a 87% increase over conventional blade tip speeds of about 152 m/s (i.e., about 500 ft/sec). The operating temperature can vary, but in one embodiment is about −179° C. (i.e., about −290° F.).

Figure 2:
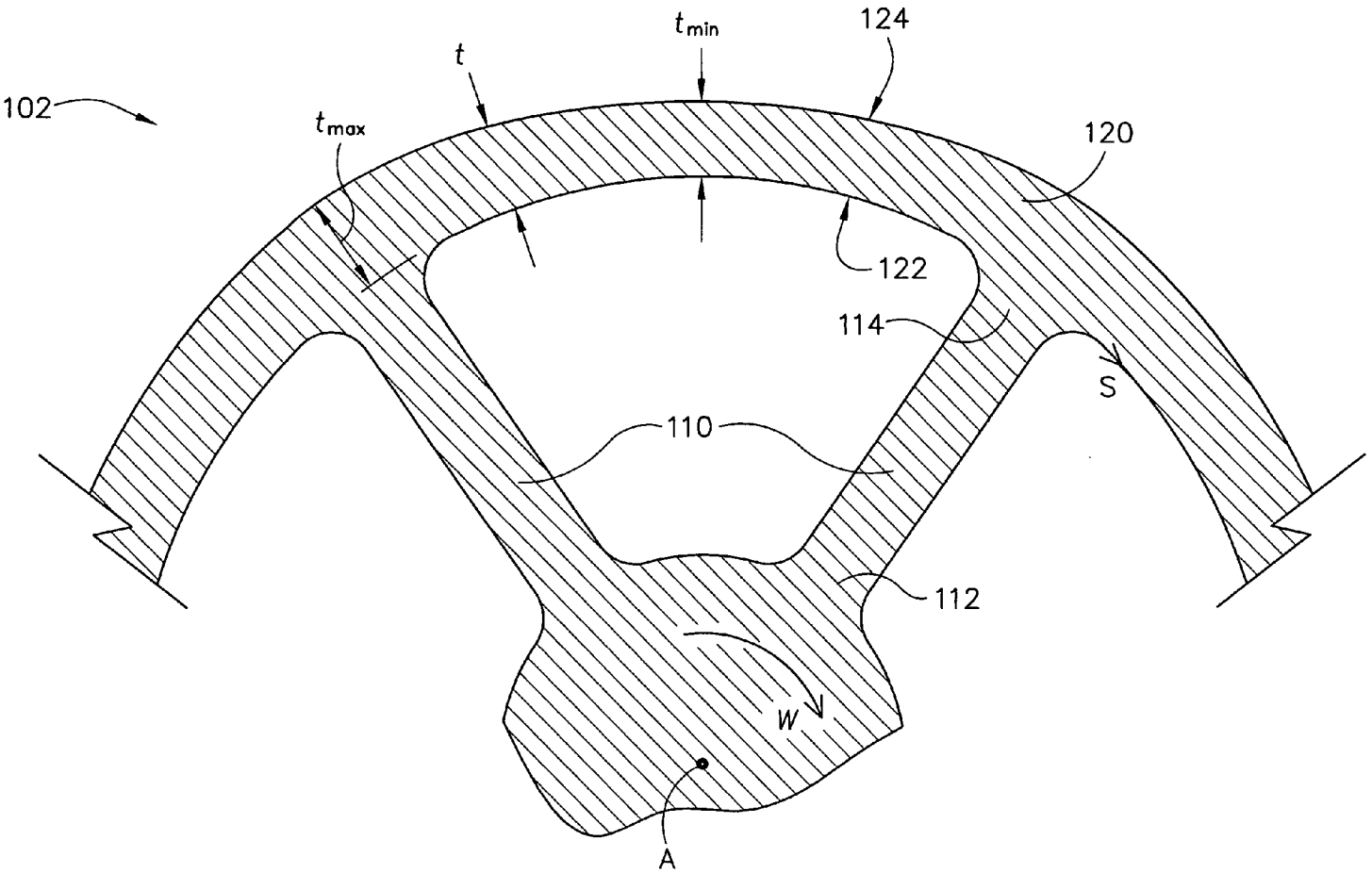
FIG. 2 is a partial cross section of a first embodiment of the inducer taken along line 2—2 of FIG. 1.

FIG. 2 shows the shroud 120 extending circumferentially between adjacent blades 110 of the rotor 102. Although the shroud 120 is shown extending circumferentially between adjacent blade tips 114, the shroud may also connect to the blades 110 at locations other than the blade tips (e.g., at mid-span) without departing from the scope of the present invention. For instance, the shroud 120 may extend circumferentially between adjacent blades 110 at a midspan of each blade 110, half-way between the corresponding root 112 and blade tip 114.

In one embodiment, the shroud 120 thickness "t" varies around the shroud. This shroud 120 thickness "t" variation reduces the mass of the shroud between the blade tips, thereby reducing deformation at speed. The decreased mass of the shroud 120 also allows use of less material to form the shroud. A lighter shroud 120 that does not compromise stress or strength characteristics allows higher speed rotor 102 operations, which in turn increases pump efficiency and overall performance of the inducer 100.

The shroud thickness "t" varies from a predetermined maximum thickness $t_{max}$ to a predetermined minimum thickness $t_{min}$. In one embodiment, maximum thicknesses are between about 0.25 cm and about 1.25 cm (i.e., about 0.1 inches and about 0.5 inches). The ratio of the maximum thickness $t_{max}$ the minimum thickness $t_{min}$ may also be predetermined. The $t_{max}$:$t_{min}$ ratio may be, for example, 2:1, 3:1, or 4:1. Centrifugal stresses and displacements may be calculated for the various ratios and thicknesses using conventional finite element analysis. Though $t_{max}$, $t_{min}$, and the ratio of $t_{max}$:$t_{min}$ may vary, consideration of at least the shroud stresses and displacements, and shroud and rotor weights, reveal that a preferred maximum thickness $t_{max}$ is in the range of about 0.75 cm and about 1.25 cm (i.e., about 0.3 inches to about 0.5 inches), and that a preferred ratio is about 3:1.

The locations of the predetermined maximum thickness $t_{max}$ and predetermined minimum thickness $t_{min}$ can vary. In one embodiment, as shown in FIG. 2, the predetermined maximum thickness $t_{max}$ is located adjacent each of the blade tips 114 and the predetermined minimum thickness $t_{min}$ is located circumferentially between, and more particularly, mid-way between, adjacent blade tips.

The resting shape of the inducer shroud 120—that is, the shape of the shroud when the inducer is not in operation—may vary depending on parameters such as the maximum thickness $t_{max}$ and minimum thicknesses $t_{min}$. However, when the rotor 102 is rotating at its operating speed, the outer surface 124 of the shroud is preferably circular to minimize the area of the gap between the shroud 120 and the interior surface 132 of the housing 104.

Figure 3:
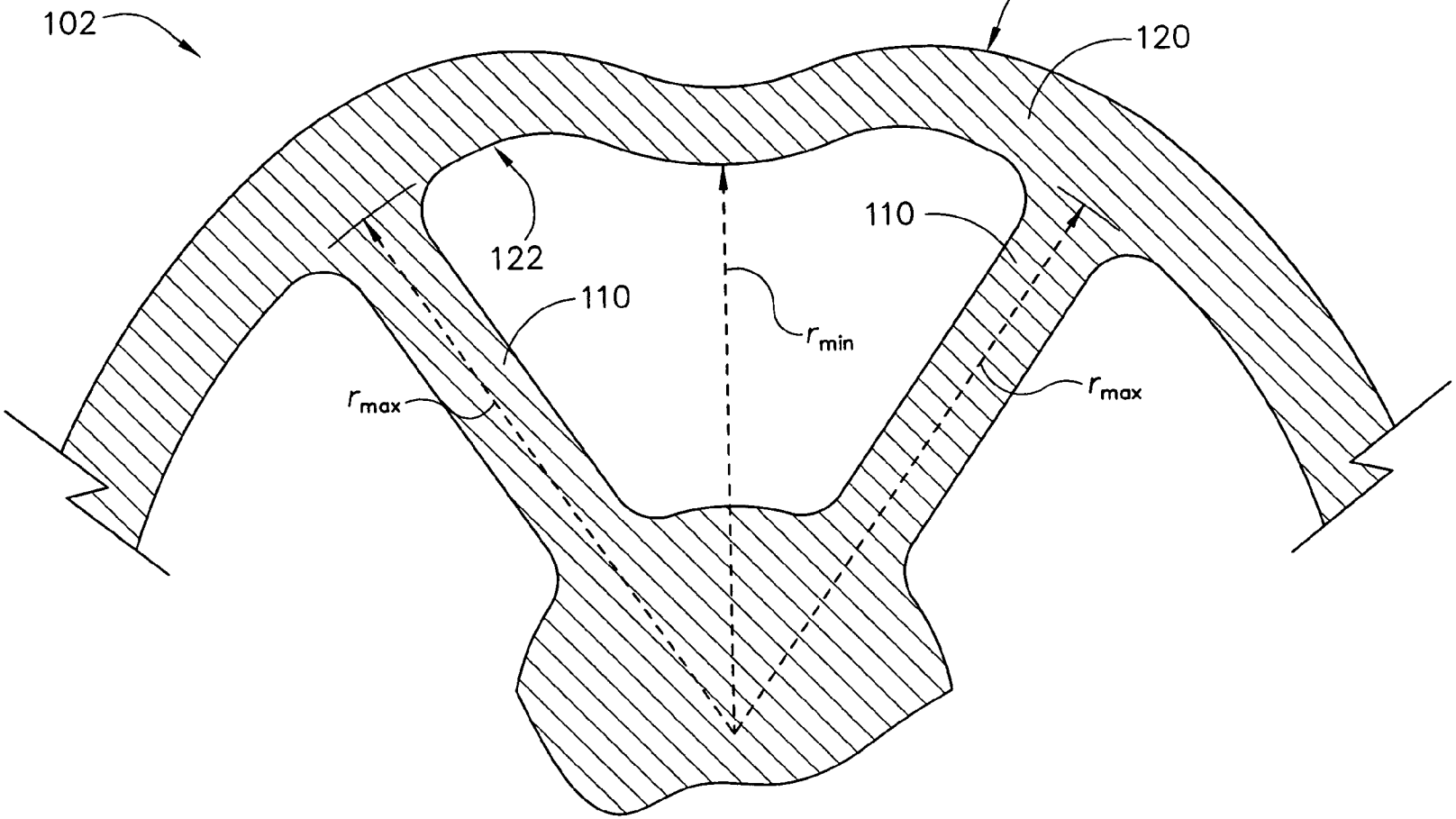
FIG. 3 is a partial cross section of a second embodiment of the inducer taken along line 2—2 of FIG. 1.

In a second embodiment shown in FIG. 3, the inner radius 122 of the shroud 120 increases and decreases between each blade 110 and a midspan of the shroud positioned between adjacent blades. Specifically, the radius decreases from a maximum radius $r_{max}$ adjacent the blade 110 to a minimum radius $r_{min}$ midway between the blades. The maximum thickness $t_{max}$, the minimum thickness $t_{min}$, the ratio of the maximum to minimum thicknesses $t_{max}$:$t_{min}$, the distribution of the variation in thickness "t", and the shroud shape, are such that when the pressure within the rotor shroud 120 generally equals the predetermined operating pressure, and when the rotor 100 is rotating at about the predetermined rotational speed "ω", the outer surface 124 of the shroud 120 is substantially circular. For example, under the stated predetermined conditions, the outer surface 124 of the shroud 120 preferably varies from circular by less than about 0.75 cm (i.e., about 0.30 inches).

Figure 4:
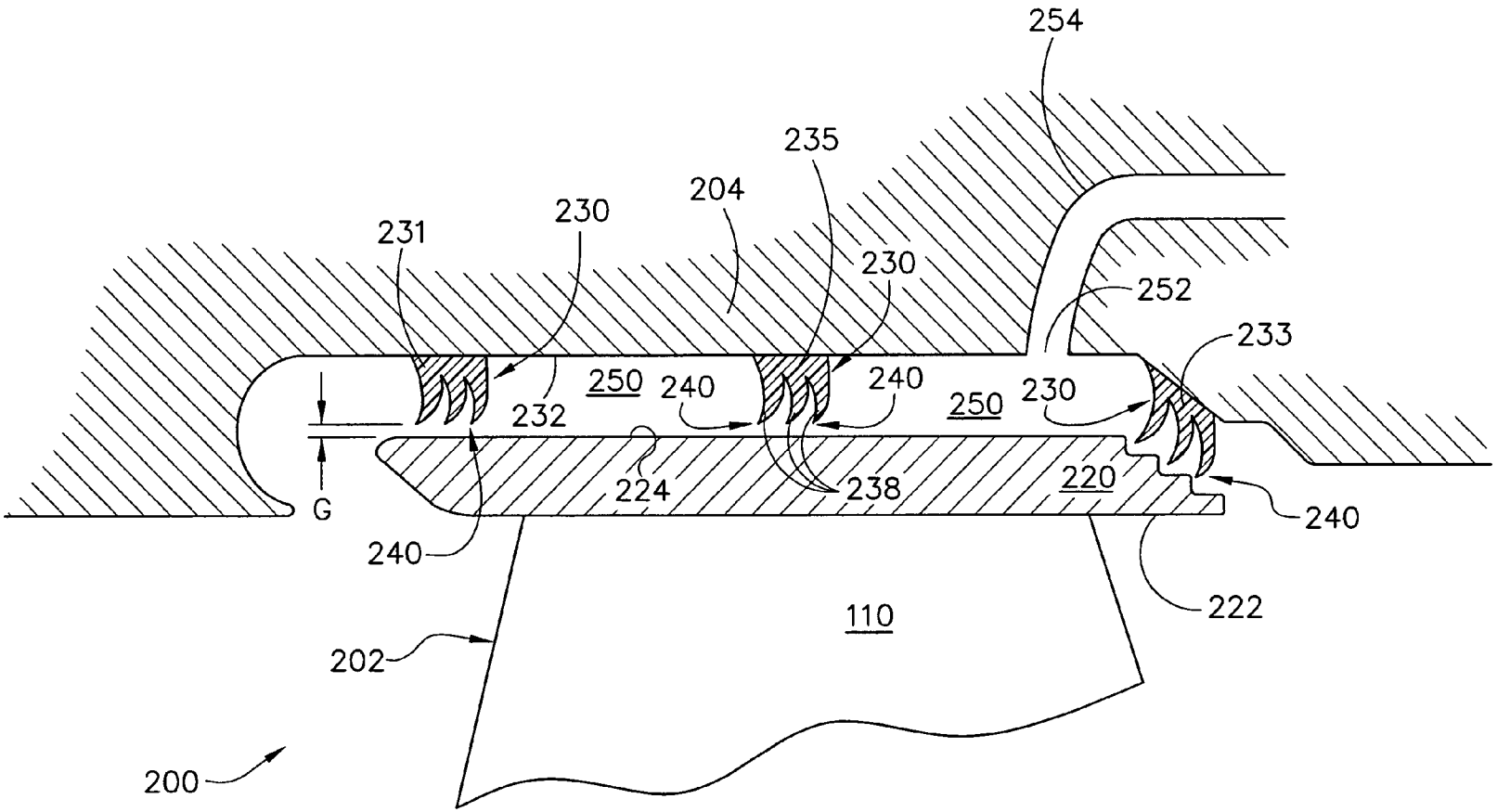
FIG. 4 is a partial vertical cross section of an alternate embodiment of the present invention.

FIG. 4 shows an alternate embodiment of the inducer 200 having a plurality of seals 230, including a leading seal 231 adjacent the leading edge of the blade 110, a trailing seal 233 adjacent the trailing edge of the blade, and an intermediate seal 235 between the leading seal and the trailing seal. Each of the seals 230 comprises one or more axially spaced seal teeth 238. In addition to being axially spaced, the seal teeth 238 of any or all of the seals 230 may also be radially spaced, as shown in FIG. 4, and the resulting stepped configuration increases the efficiency of the seal.

A gap "G" is formed between the tip 240 of each seal 230 and the shroud 220. The leading seal gap, between the tip 240 of the leading seal 231 and the shroud 220, is specifically identified in FIG. 4. It will be appreciated that trailing and intermediate gaps likewise exist between the shroud 220 and the trailing seal 233 and any intermediate seals 235, respectively.

An annular cavity 250 is defined between the interior surface 232 of the housing 204, the outer surface 224 of the shroud 220, the leading seal 231, and the trailing seal 233. The cavity 250 may be pressurized during inducer operation to deform the shroud inward, thereby maintaining the leading seal gap and the trailing seal gap at respective substantially uniform heights. Cavity pressurization may also result in the reduction of the stress levels in the shroud during operation. Radial pressure forces exerted on the shroud 220 due to the pressure differential between the inner shroud surface 222 and outer shroud surface 224 are used to at least partially balance the loads caused by the centrifugal forces on the shroud during operation. The amount of pressurization in the cavity 250 is such that, when the rotor 202 is operating at the predetermined rotational operating speed "ω" and predetermined operating pressure, the outer surface 224 of the shroud 220 is substantially circular. Under these operating conditions, the outer surface 224 varies from round by no more than about 0.75 cm (i.e., about 0.30 inches) in one embodiment.

Pressurization of the cavity 250 may be accomplished by introducing fluid through a port 252 in the interior surface 232 of the housing 204. In this case, fluid is supplied to the port 252 by a supply line 254. The supply line 254 may supply fluid from a location downstream from the inducer 200. For example, the fluid introduced into the cavity 250 by way of the supply line 254 and port 252 may be supplied from a location near the outlet of the inducer 200 or a location further downstream from the inducer.

The intermediate seals 235 allow increased control of the pressure differential within the cavity 250. Thus, pressure can be focused where it is needed more based on the design and operating conditions of the inducer. For example, if it is determined that significantly more support is required toward the trailing part of the shroud 220, that is, the part of the shroud closer to the outlet of the inducer, then intermediate seals 235 can be provided to increase the pressure in the cavities closer to the trailing part. To further increase the pressure near the trailing parts, the gap "G" between the intermediate seal(s) and the shroud 220 can be decreased. Also, the increased shroud 220 strength resulting from the pressure forces allows for use of less shroud material, thereby reducing the weight and cost, and increasing the performance of the inducer.

In one embodiment, the shroud is circumferentially tapered—i.e., from a maximum thickness $t_{max}$ to a minimum thickness $t_{min}$—and the cavity 250 between the leading 231 and trailing 233 seal is pressurized. Under these conditions, the weight, strength, and overall performance, including the blade tip speed, of the inducer 200 is optimized.

In view of the above, it will be seen that the several objects of the invention are achieved.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. An inducer rotor rotatably mountable in an inducer for pressurizing fluid traveling through the inducer, said inducer rotor comprising:

a hub having a central axis:

a plurality of blades connected to the hub, each of said plurality of blades extending radially outward from a root adjacent the hub to a tip opposite the root; and a unitary, one-piece, shroud extending circumferentially between at least one pair of adjacent blades within the plurality of blades, said shroud having an inner surface facing the central axis, an outer surface opposite the inner surface and a thickness extending between said inner and outer surface, said thickness varying circumferentially around the shroud, wherein said shroud thickness varies around the shroud so that the outer surface of the shroud is substantially circular when the rotor is rotating at a predetermined rotational operating speed.

2. An inducer rotor as set forth in claim 1 wherein said shroud thickness varies around the shroud so that the outer surface of the shroud varies from circular by no more than 0.30 inches when the rotor is rotating at the predetermined rotational operating speed.

3. An inducer as set forth in claim 1 wherein the blade tips have a circumferential tip speed of about 936 ft/sec when the rotor is operating at the predetermined rotational operating speed.

4. An inducer as set forth in claim 1 wherein the shroud extends circumferentially between blades adjacent the blade tips.

5. An inducer rotor as set forth in claim 4 wherein the shroud thickness varies from a predetermined minimum thickness located circumferentially between each adjacent pair of blade tips to a predetermined maximum thickness located adjacent each blade tip.

6. An inducer rotor as set forth in claim 5 wherein the minimum shroud thickness is located circumferentially midway between each adjacent pair of blade tips.

7. An inducer rotor as set forth in claim 5 wherein a shroud radius varies circumferentially along each shroud between adjacent blades of the plurality of blades such that the shroud radius decreases from a maximum shroud radius adjacent the blades to a minimum shroud radius as a midpoint of the shroud between the blades.

8. An inducer rotor having a predetermined rotational speed mountable in an inducer for pressurizing fluid traveling through the inducer, the inducer comprising a housing surrounding the rotor having an interior surface facing the outer surface of the shroud, said housing extending axially from an inlet through which fluid is received at an inlet pressure to an outlet downstream from said inlet through which fluid is discharged at an outlet pressure higher than said inlet pressure, the inducer rotor comprising:

a hub having a central axis;

a plurality of blades connected to the hub, each of said plurality of blades extending radially outward from a root adjacent the hub to a tip opposite the root; and a unitary, one-piece, shroud extending circumferentially between at least one pair of adjacent blades within the plurality of blades, said shroud having an inner surface facing the central axis, an outer surface opposite the inner surface and a thickness extending between said inner and outer surface, said thickness varying circumferentially around the shroud, wherein the shroud extends circumferentially between blades adjacent the blade tips.

9. An inducer rotor as set forth in claim 8 having a predetermined operating pressure between said inlet and outlet pressures, and wherein said shroud thickness varies around the shroud so that the outer surface of the shroud is substantially circular when pressure within the rotor shroud generally equals the predetermined operating pressure.

10. An inducer rotor as set forth in claim 9 wherein said shroud thickness varies around the shroud so that the outer surface of the shroud varies from circular by no more than about 0.30 inches when the rotor is rotating at a predetermined rotational operating speed.

11. An inducer for pressurizing a fluid comprising:

a housing having an interior surface facing a central axis, an inlet through which fluid is received into the housing at an inlet pressure, and an outlet downstream from the inlet through which fluid is discharged from the housing at an outlet pressure higher than said inlet pressure;

a rotor rotatably mounted in the housing, said rotor comprising a hub centered on the central axis, a plurality of blades connected to the hub, each of said plurality of blades extending radially outward from a root adjacent the hub to a tip opposite the root and axially rearward from a leading edge to a trailing edge opposite the leading edge, and a shroud extending circumferentially between each pair of adjacent blades within the plurality of blades, said shroud having an inner surface facing the central axis, an outer surface opposite the inner surface and a thickness extending between said inner surface and outer surface; and a leading seal extending from at least one of the interior surface of the housing and the outer surface of the shroud thereby forming a leading seal gap, and a trailing seal extending from at least one of the interior surface of the housing and the outer surface of the shroud thereby forming a trailing seal gap, said leading seal being closer to the leading edge of the blades than the trailing seal;

wherein the interior surface of the housing, the outer surface of the shroud, the leading seal, and the trailing seal define an annular cavity, the cavity being pressurized for maintaining the leading seal gap and the trailing seal gap at respective substantially uniform heights during inducer operation.

12. An inducer as set forth in claim 11 wherein at least one of the leading seal and the trailing seal has a plurality of axially spaced seal teeth.

13. An inducer as set forth in claim 12 wherein the axially spaced seal teeth are radially offset from each other.

14. An inducer as set forth in claim 11 wherein the rotor has a predetermined rotational operating speed at which a predetermined operating pressure is developed in the inducer between the inlet pressure and the outlet pressure, and wherein said outer surface of the shroud is substantially circular when the rotor is rotating at the predetermined rotational operating speed and the predetermined operating pressure is developed in the inducer.

15. An inducer as set forth in claim 14 wherein said outer surface of the shroud varies from round by no more than 0.30 inches when the rotor is rotating at the predetermined rotational operating speed and the predetermined operating pressure is developed in the inducer.

16. An inducer as set forth in claim 14 wherein the predetermined rotational operating speed of the inducer rotor is between about 6,000 rpm and about 30,000 rpm.

17. An inducer as set forth in claim 14 wherein the predetermined operating pressure is between 5 psi and about 1,500 psi.

18. An inducer as set forth in claim 11 wherein the interior surface of the housing includes a port for introducing fluid to the cavity thereby to pressurize the cavity.

19. An inducer as set forth in claim 18 wherein the port is supplied with fluid by a supply line from a source downstream from the outlet of the housing.

20. An inducer as set forth in claim 11 further comprising at least one seal intermediate the leading seal and the trailing seal.

21. An inducer as set forth in claim 11 wherein the shroud extends circumferentially between blades adjacent the blade tips and the shroud thickness varies from a predetermined minimum thickness located circumferentially between each adjacent pair of blade tips to a predetermined maximum thickness located adjacent each blade tip.

* * * * *